US008651299B2

(12) United States Patent
Fromm et al.

(10) Patent No.: US 8,651,299 B2
(45) Date of Patent: Feb. 18, 2014

(54) POINT OF SALE STORE DISPLAY ASSEMBLY

(75) Inventors: Michael William Fromm, Trumbull, CT (US); Christina Diane Cvetan, Brampton (CA)

(73) Assignee: Conopco, Inc., Englewood Cliffs, NJ (US)

( * ) Notice: Subject to any disclaimer, the term of this patent is extended or adjusted under 35 U.S.C. 154(b) by 93 days.

(21) Appl. No.: 13/424,928

(22) Filed: Mar. 20, 2012

(65) Prior Publication Data

US 2013/0248472 A1 Sep. 26, 2013

(51) Int. Cl.

| | |
|---|---|
| ***A47F 5/02*** | (2006.01) |
| ***A47B 49/00*** | (2006.01) |
| ***A47B 57/06*** | (2006.01) |

(52) U.S. Cl.

USPC ..... 211/144; 211/131.1; 211/133.4; 211/196

(58) Field of Classification Search

CPC ..... A47F 5/02; A47B 49/00; A47B 49/004; A47B 46/005; A47B 57/06

USPC ..... 211/72, 73, 189, 195, 144, 186, 187, 211/134, 58, 71.01, 190, 13.1, 163, 70, 78, 211/95, 131.1, 133.4, 196, 205, 107; 108/180, 181, 183, 184; 220/23.83, 220/23.86, 23.88, 23.89

See application file for complete search history.

(56) References Cited

U.S. PATENT DOCUMENTS

| | | | | | |
|---|---|---|---|---|---|
| 398,604 | A * | 2/1889 | Ganter | 312/123 |
| 615,032 | A * | 11/1898 | Mandel | 312/135 |
| 841,180 | A * | 1/1907 | Joyce | 312/33 |
| 988,269 | A * | 3/1911 | Svalland | 312/305 |
| 1,908,797 | A * | 5/1933 | Svalland | 312/305 |
| 4,796,960 | A * | 1/1989 | Candelas | 312/305 |
| 5,799,787 | A * | 9/1998 | Talbot | 206/315.11 |
| 6,016,927 | A * | 1/2000 | Krupp | 211/126.2 |
| 6,631,804 | B2 * | 10/2003 | Wong | 206/526 |
| 7,571,811 | B2 * | 8/2009 | Mulaw | 206/535 |
| 8,210,373 | B2 * | 7/2012 | Liao | 211/131.1 |
| 8,459,474 | B2 * | 6/2013 | Sagel | 211/144 |
| 2001/0013743 | A1 * | 8/2001 | Twellmann | 312/238 |
| 2003/0173321 | A1 * | 9/2003 | Craft et al. | 211/144 |
| 2009/0230069 | A1 * | 9/2009 | Naden et al. | 211/144 |
| 2012/0241400 | A1 * | 9/2012 | Hardin | 211/144 |

* cited by examiner

*Primary Examiner* — Jennifer E Novosad
(74) *Attorney, Agent, or Firm* — Michael P. Aronson

(57) ABSTRACT

A free-standing display assembly is provided holding products for retail sale. The assembly includes a sub-assembly having a base, supporting shroud, left and right side walls, and slotted metal spine. An inner sleeve is held adjacent the supporting shroud. Metal shelves with plastic trays are hangable at different heights along the slotted metal spine. A first transparent plastic panel is sized to cover a rear graphic sheet which is removably insertable between the first transparent plastic panel and the supporting shroud. A second transparent plastic panel is sized to cover 5-50% of an upper area of the inner sleeve and is attached to the inner sleeve. A front graphic sheet is sandwiched between the second transparent plastic panel and the inner sleeve. The configuration of the flexible panels readily permits in under 5 minutes to replace rear and front graphic sheets with alternative advertising.

7 Claims, 5 Drawing Sheets

POINT OF SALE STORE DISPLAY ASSEMBLY

BACKGROUND OF THE INVENTION

1. Field of the Invention

The invention concerns a point of sale display assembly for in-store retail marketing of fast moving consumer goods.

2. The Related Art

Fast moving consumer goods (FMCG) meet every day consumer needs. These products encompass foods, home care and personal care. Typical foods are sauces, dressings, margarines and spreads, condiments, ice cream and tea. Home care goods can include laundry detergent, hard surface cleaners and dishwashing products. Personal care involves products in categories such as oral health, hair treatment, personal wash toiletries and various cosmetics. FMCG manufacturers succeed in the retail market by providing high quality products, branding with trusted names, value for money pricing and promotional advertising. Beyond these factors is the battle on the retail floor. One tactic is use of free-standing display racks dedicated to one or more products of a manufacturer.

Display racks face many problems. They must be sufficiently lightweight and collapsible for transport. Once in the store, they must be quick to assemble. Ease and speed of assembly are challenges not often fully achieved.

Known display assemblies are created for a single brand and type of product within that brand. Most often the assembly cannot be re-purposed to a different brand or product variant. Advertising signage hinders the makeover. Even those assemblies that can be reconverted require a return trip to the refurbishment shop.

An object of the present invention is to provide a low cost display assembly that can be easily in-store converted to a different brand or product with appropriate signage. Speed of initial assembly and conversion to a new product display should be achieved within minutes rather than hours.

SUMMARY OF THE INVENTION

A free-standing display assembly for holding products for sale in a store is provided including:

a sub-assembly including a base, a supporting shroud, a left side wall, a right side wall, the supporting shroud bridging left and right side walls, and a slotted metal spine attached to an inner surface of the supporting shroud;

an inner sleeve held adjacent the supporting shroud and having an elongate aperture to allow open access to the slotted metal spine;

a plurality of metal shelves removable and hangable at different heights along a vertical length of the slotted metal spine;

a plurality of plastic trays each supported on one of the plurality of metal shelves;

a rear graphic sheet of a size covering an outer surface of the supporting shroud;

a first transparent plastic panel sized to cover the rear graphic sheet, a first vertical edge of the panel being hingedly attached along a length thereof to the right side wall and a second vertical edge having a securing member engageable with a cooperative member attached to the left side wall, the rear graphic sheet being removably insertable between the transparent plastic panel and the supporting shroud;

a second transparent plastic panel sized to cover between 5 and 50% of an upper area of the inner sleeve, the second transparent plastic panel being attached to an outer surface of the inner sleeve; and a front graphic sheet sandwiched between the second transparent plastic panel and the inner sleeve.

One or more wheels may be attached to the base for moving the assembly from one to another position on a store floor. In alternate embodiments, wheels are absent. The plurality of shelves and the plurality of trays in one embodiment are oval in shape. Congruently the base, the supporting shroud, the left and right side walls may all possess a curvilinear shape.

The supporting shroud may be formed with a plurality of curvilinear ribs parallel to one another.

Each of the plastic trays may be vacuum formed. Further, each of the plastic trays along a perimeter thereof may feature an undulating skirt.

Further disclosed is a method of displaying merchandise in the store. The method involves placing packaged goods on shelves of a free-standing display assembly, the assembly being described above.

BRIEF DESCRIPTION OF THE DRAWING

Further benefits and features of the present invention will become more apparent from consideration of the following drawing in which.

DETAILED DESCRIPTION OF THE INVENTION

Now there has been developed a free-standing display assembly for holding products for sale in a store which solves many of the problems heretofore encountered. The assembly is lightweight, easily transportable, and has shelf heights adjustable to accommodate different height sizes of goods. Replaceable advertising signage appears visible on front and rear panels of the assembly. Of particular note, is that resignage (exchange of both front and rear graphic sheets) with substitute sheets having different graphics can be accomplished in less than 5 minutes, normally within the range of from 0.1 to 3 minutes, and optimally from 0.5 to 2 minutes.

Figure 1C:
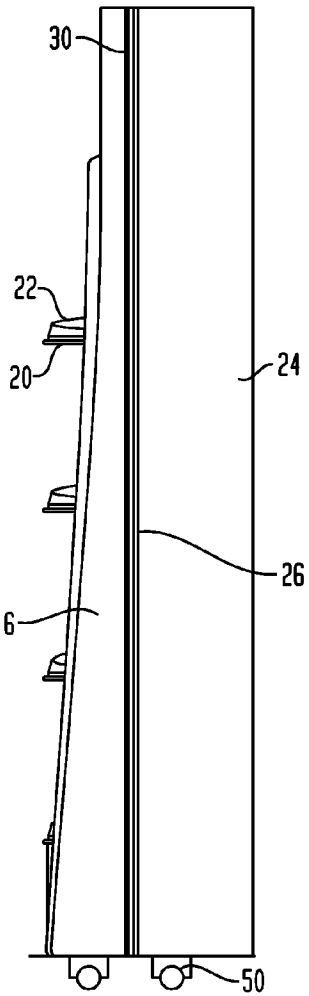
FIG. 1*c* is a left side view of the display assembly shown in FIG. 1*a;*
Figure 1B:
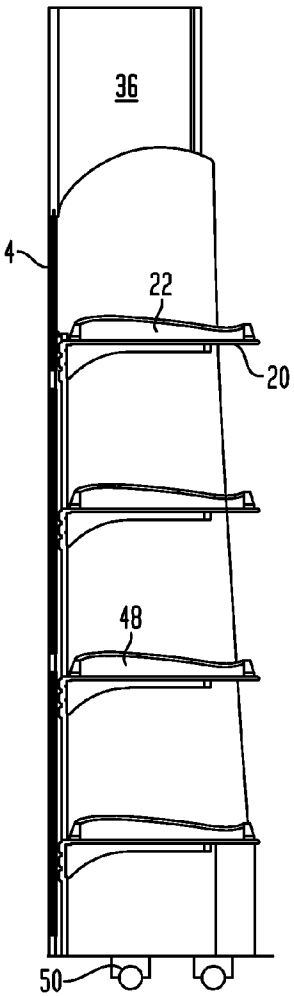
FIG. 1*b* is a right side view of the display assembly shown in FIG. 1*a;*
Figure 1A:
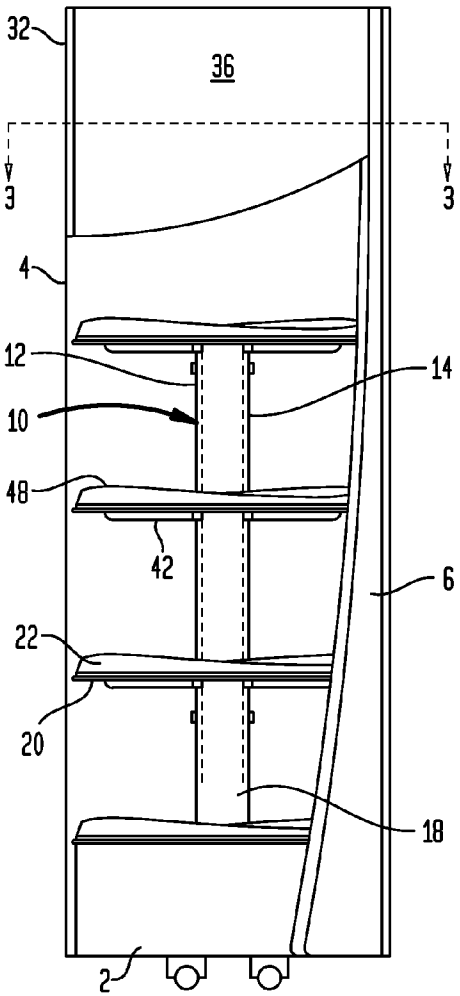
FIG. 1*a* is a front perspective view of a display assembly embodying the invention.

FIG. 1*a* through 1*c* reveal different views of the constructed display assembly. Members include a base 2, a left side wall 4 and a right side wall 6. A supporting shroud 8 (best seen in FIG. 2) forms a bridge between the left and right side walls. A slotted metal spine 10 is attached to an inner surface of the supporting shroud. The slotted metal spine includes a left rail 12 and a right rail 14.

An inner sleeve 16 is held adjacent the supporting shroud and has an elongate aperture 18 to allow open access to the slotted metal spine.

Three metal shelves 20 are supported at different heights from different slots along metal spine 10. A set of four vacuum-formed plastic trays 22 are seated each on a respective one of the shelves.

Another component of the display assembly is a flexible first transparent plastic panel 24. This panel is of a height and width to overlap the supporting shroud 8 and covers at least a portion of the left side wall 4. A first vertical edge 26 of panel 24 is hingedly attached along a length thereof to the right side wall 6. A second vertical edge 28 distant from the first vertical edge features a securing member 30 engageable with a cooperative member 32 attached to the left side wall.

Figure 2:
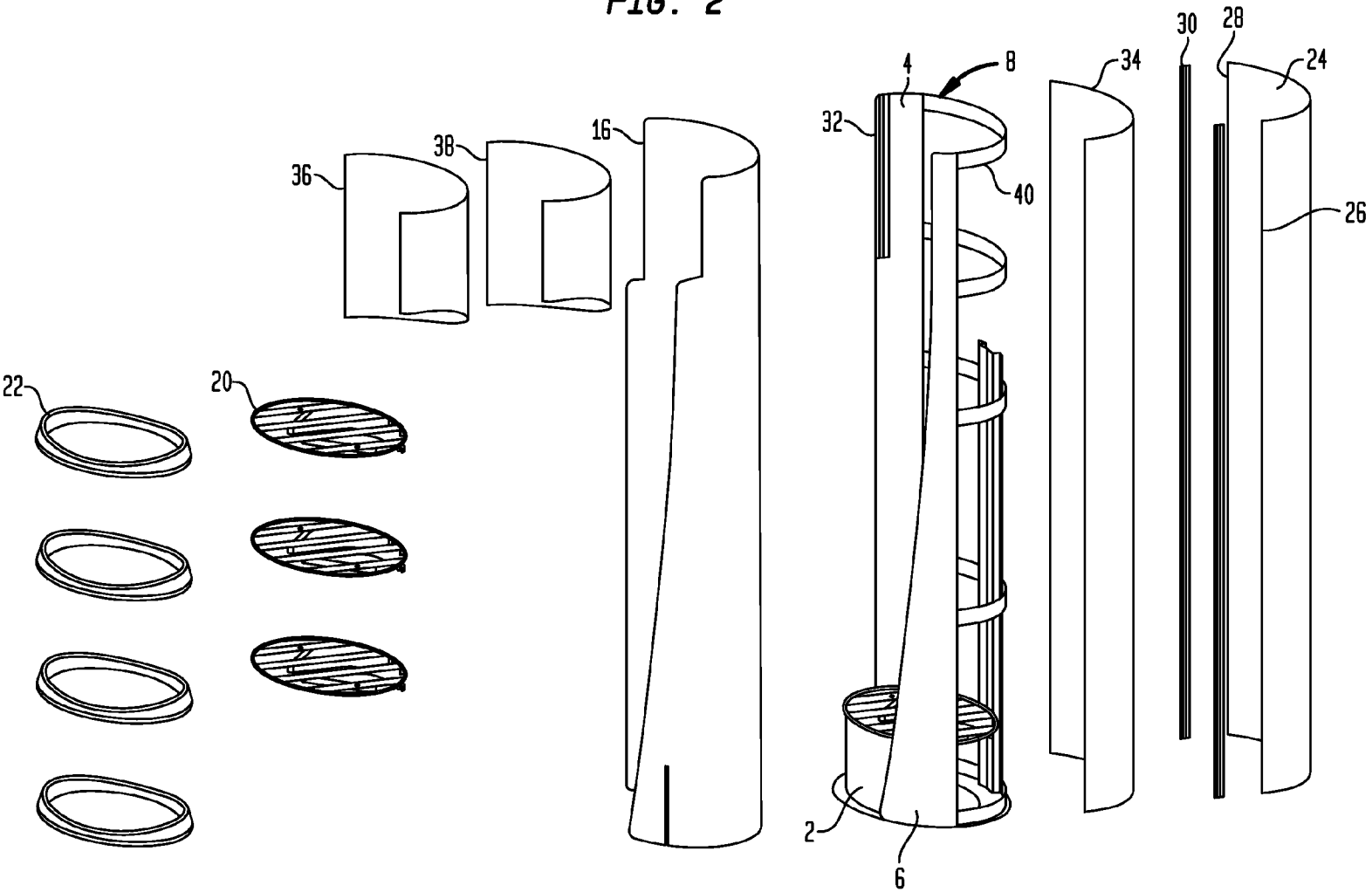
FIG. 2 is an exploded view of components of the embodiment shown in FIG. 1*a-c;*

FIG. 2 best illustrates each element of the display assembly in relation to other elements. A rear graphic sheet 34 of a size covering an outer surface of the supporting shroud is removably positioned between the first transparent plastic panel and the supporting shroud.

A second transparent plastic panel 36 sized to cover between 5 and 50% of an upper area of the inner sleeve 16 is attached to a surface of the inner sleeve. A front graphic sheet 38 is removably supported between the second transparent plastic panel and the inner sleeve.

The walls and the shroud of this invention in certain embodiments can be squared-off or rectangular with edges of each component meeting at right angles. As seen in the Figures, a preferred embodiment has ovality. An oval shape is seen in the plurality of shelves, the plurality of trays and their shroud and side walls. Not only oval but any type of curvilinear shape may be suitable for the shelves, trays, shroud and walls of the display assembly.

As best viewed in FIG. 2, the supporting shroud may comprise a plurality of curvilinear ribs 40 parallel to one another.

Figure 3:
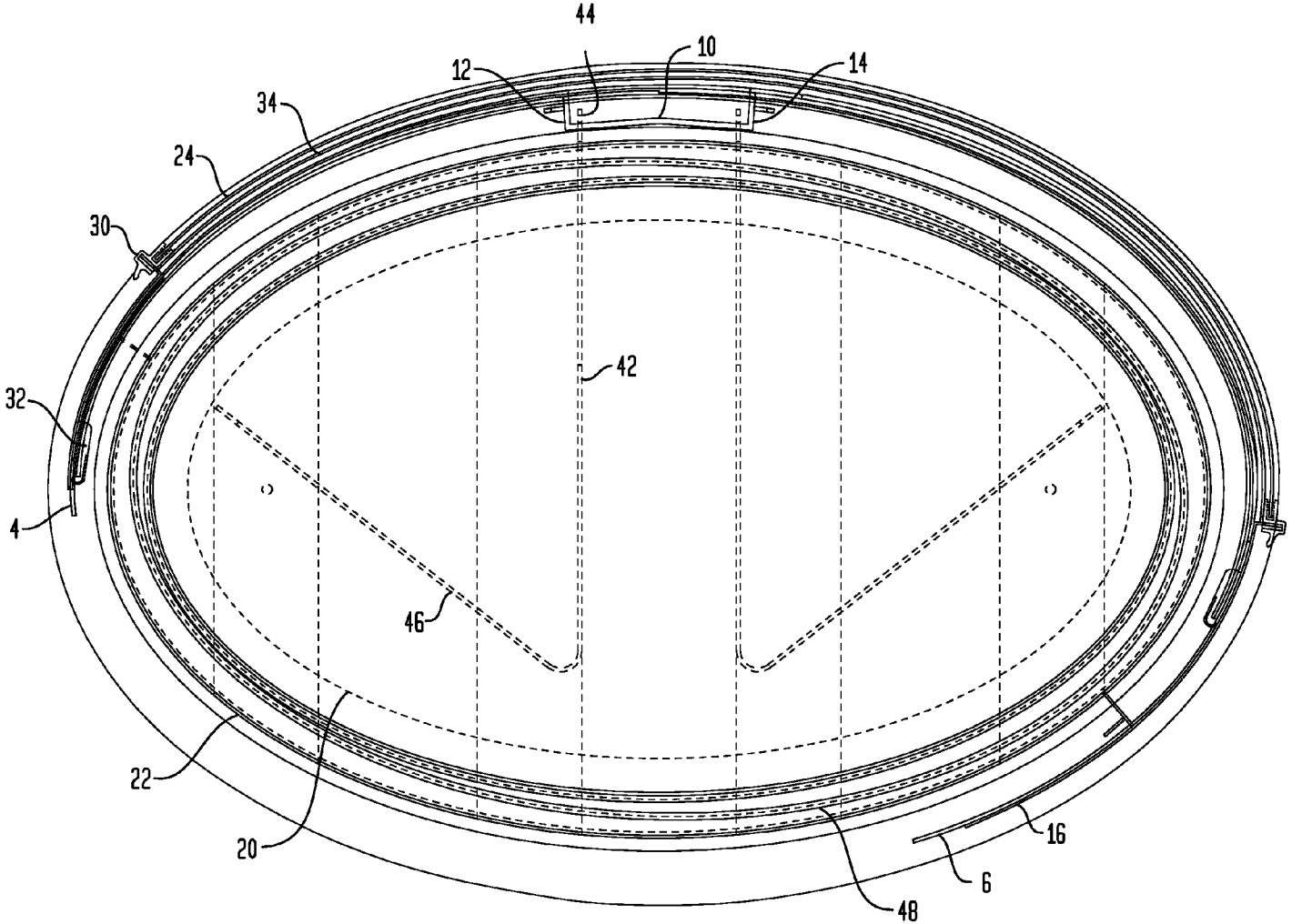
FIG. 3 is a top plan view of the display assembly taken along line 3-3 of FIG. 1*a;*

FIG. 3 best illustrates the layered relationship of the base, the supporting shroud, the left and right side walls, the inner sleeve, the metal shelves, the plastic trays, the first and second transparent plastic panels, and the rear and front graphic sheets. Of particular functionality are a pair of arms 42 upon which the metal shelf 20 rests. These arms at one end have a hook 44 engaged with a slot on the slotted metal spine 10. Each of the arms 42 includes an angular section 46 positioned between 30 and 80° angle from the main section of arm 42.

The plastic trays 22 can be constructed in various ways. Preferably the trays are vacuum formed as a single unitary piece. Along a perimeter of each tray is an undulating skirt 48 with some sections of greater width than others. The skirt securely lodges over an outer edge of its respective metal shelf.

Figure 4:
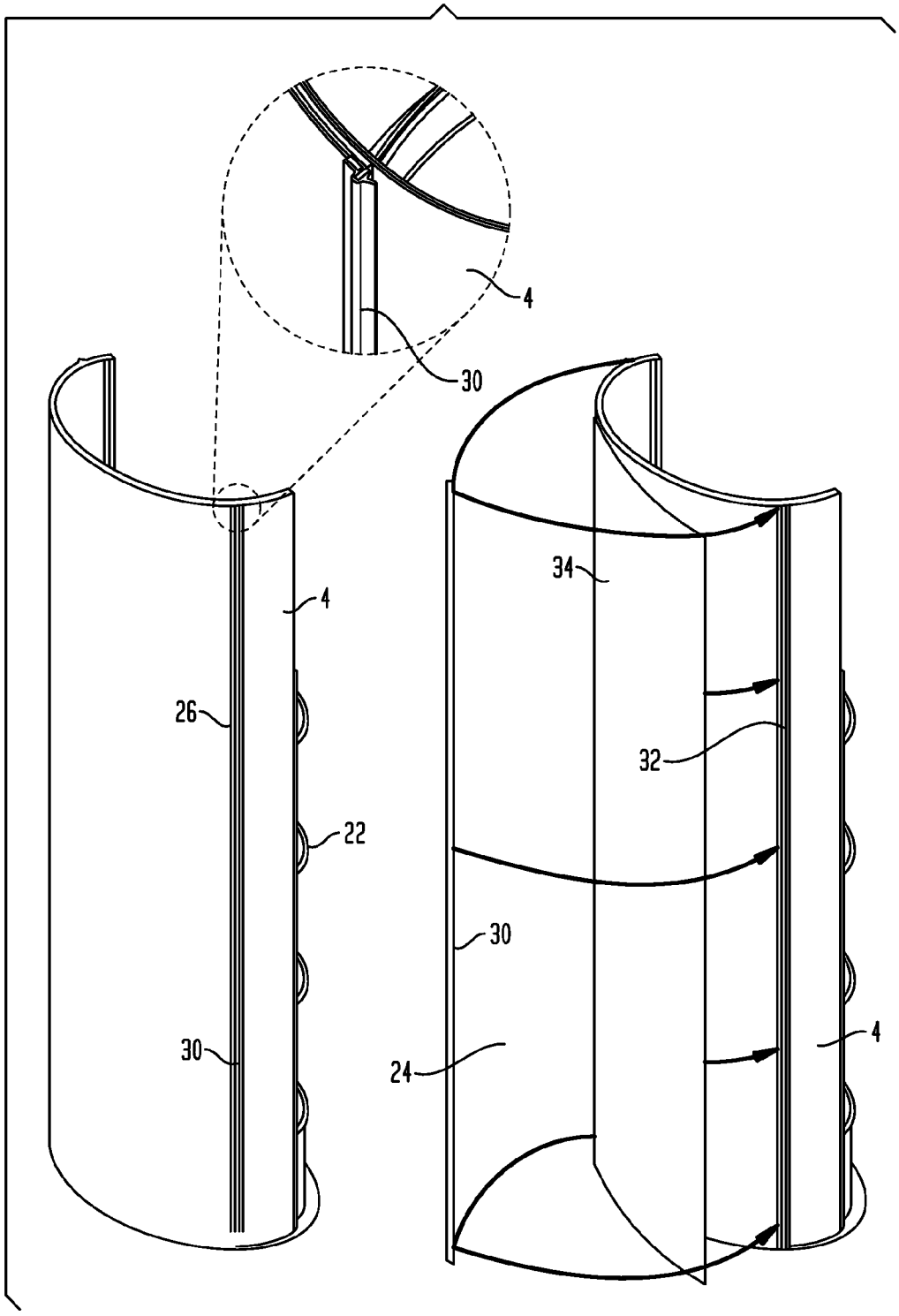
FIG. 4 illustrates the method of resignage replacing one rear graphic sheet for another.

FIG. 4 illustrates the ease by which the rear graphic sheet can be replaced. The signage replacement procedure starts by pulling securing member 30 away from cooperative member 32 and the supporting shroud 8. This frees the rear graphic sheet 34 which simply is withdrawn and an alternative printed rear graphic sheet with advertisement surface facing the first transparent plastic panel 24 is inserted between that panel and the shroud. Panel 24 is then closed by reclipping securing member 30 to cooperative member 32.

Figure 5:
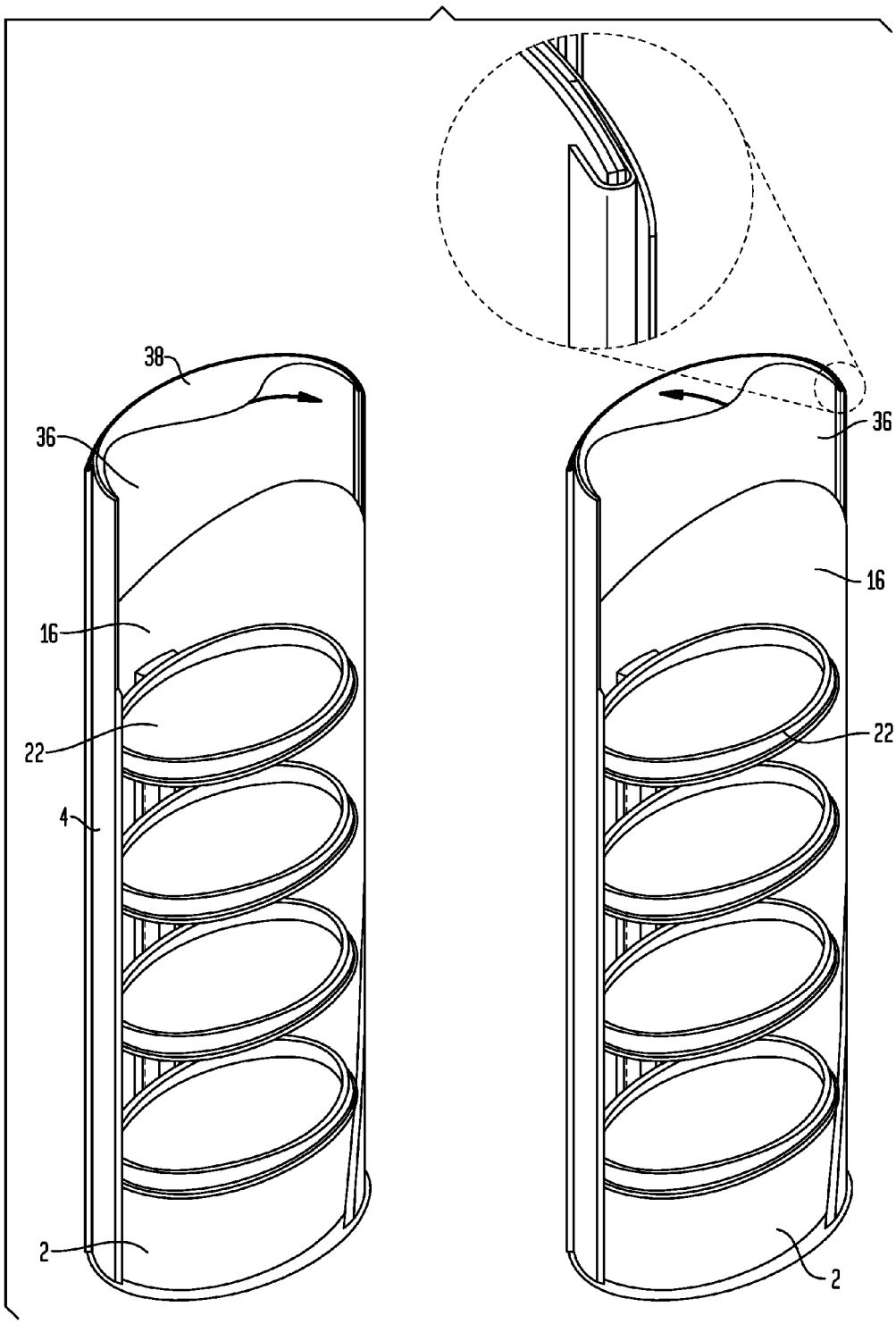
FIG. 5 illustrates resignage exchange of one front graphic sheet for another.

FIG. 5 best illustrates the resignage on the front of the display assembly. Replacement of signage for the front face of the display assembly begins by gripping and outwardly extending the flexible second transparent plastic panel 36. The front graphic sheet 38 is then pulled upwards and away from the display assembly. A differently printed front graphic sheet is then inserted to be sandwiched between the second transparent plastic panel and the inner sleeve. Once this has been accomplished, the second transparent plastic panel can be allowed to relax back to its original position snuggly adjacent in a sleeve 16.

Mobility of the display assembly is improved by a set of wheels 50 below the base. The wheels allow for moving the display assembly from one to another position on a store floor.

The term "comprising" is meant not to be limiting to any subsequently stated elements but rather to encompass non-specified elements of major or minor functional importance. In other words, the listed steps, elements or options need not be exhaustive. Whenever the words "including" or "having" are used, these terms are meant to be equivalent to "comprising" as defined above.

While the invention has been described in detail with reference to specific embodiments thereof, it would be apparent to one of skill in the art that various changes and modifications could be made therein without departing from the spirit and scope thereof.

What is claimed is:

1. A free-standing display assembly for holding products for sale in a store comprising:

a sub-assembly comprising a base, a supporting shroud, a left side wall, a right side wall, the supporting shroud bridging the left and right side walls, and a slotted metal spine attached to an inner surface of the supporting shroud;

an inner sleeve held adjacent the supporting shroud and having an elongate aperture to allow open access to the slotted metal spine;

a plurality of metal shelves removable and hangable at different heights along a vertical length of the slotted metal spine;

a plurality of plastic trays each supported on one of the plurality of metal shelves;

a rear graphic sheet of a size covering an outer surface of the supporting shroud;

a first transparent plastic panel sized to cover the rear graphic sheet, a first vertical edge of the panel being hingedly attached along a length thereof to the right side wall and a second vertical edge having a securing member engageable with a cooperative member attached to the left side wall, the rear graphic sheet being removably insertable between the transparent plastic panel and the supporting shroud;

a second transparent plastic panel sized to cover between 5 and 50% of an upper area of the inner sleeve, the second transparent plastic panel being attached to an outer surface of the inner sleeve; and a front graphic sheet sandwiched between the second transparent plastic panel and the inner sleeve.

2. The assembly according to claim 1 further comprising one or more wheels below the base for moving the assembly from one to another position on a store floor.

3. The assembly according to claim 1 wherein the plurality shelves and the plurality of trays are oval in shape.

4. The assembly according to claim 1 wherein the supporting shroud comprises a plurality of curvilinear ribs parallel to one another.

5. The assembly according to claim 1 wherein each of the plastic trays are vacuum formed.

6. The assembly according to claim 1 wherein each of the plastic trays along a perimeter thereof have an undulating skirt.

7. The method of displaying merchandise comprising:

placing packaged goods on shelves of a free-standing display assembly, the assembly comprising:

a sub-assembly comprising a base, a supporting shroud, a left side wall, a right side wall, the supporting shroud bridging the left and right side walls, and a slotted metal spine attached to an inner surface of the supporting shroud;

an inner sleeve held adjacent the supporting shroud and having an elongate aperture to allow open access to the slotted metal spine;

a plurality of metal shelves removable and hangable at different heights along a vertical length of the slotted metal spine;

a plurality of plastic trays each supported on one of the plurality of metal shelves;

a rear graphic sheet of a size covering an outer surface of the supporting shroud;

a first transparent plastic panel sized to cover the rear graphic sheet, a first vertical edge of the panel being hingedly attached along a length thereof to the right side wall and a second vertical edge having a securing member engageable with a cooperative member attached to the left side wall, the rear graphic sheet being removably insertable between the transparent plastic panel and the supporting shroud;

a second transparent plastic panel sized to cover between 5 and 50% of an upper area of the inner sleeve, the second transparent plastic panel being attached to an outer surface of the inner sleeve; and a front graphic sheet sandwiched between the second transparent plastic panel and the inner sleeve.

* * * * *